US006369288B1

(12) United States Patent
Brown

(10) Patent No.: US 6,369,288 B1
(45) Date of Patent: Apr. 9, 2002

(54) CHEMICAL AND BIOLOGICAL WARFARE DECONTAMINATING SOLUTION USING BLEACH ACTIVATORS

(75) Inventor: Jerry S. Brown, Woodford, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/477,941

(22) Filed: Jan. 5, 2000

(51) Int. Cl.[7] ..... A62D 3/00
(52) U.S. Cl. ..... 588/200
(58) Field of Search ..... 588/200; 252/100, 252/94; 510/110, 277; 514/643

(56) References Cited

U.S. PATENT DOCUMENTS

| | | | | |
|---|---|---|---|---|
| 3,163,606 | A | 12/1964 | Viveen et al. | 252/98 |
| 3,211,658 | A | 10/1965 | Hirtz et al. | 252/99 |
| 3,956,159 | A | 5/1976 | Jones | 252/104 |
| 4,483,781 | A | 11/1984 | Hartman | 252/174.12 |
| 4,536,313 | A | 8/1985 | Hignett et al. | 252/100 |
| 4,539,130 | A | 9/1985 | Thompson et al. | 252/94 |
| 4,541,944 | A | 9/1985 | Sanderson | 252/95 |
| 4,681,592 | A | 7/1987 | Hardy et al. | 8/111 |
| 4,783,194 | A | 11/1988 | Dugenet et al. | 8/111 |
| 5,360,573 | A | 11/1994 | Smith et al | 252/186.39 |
| 5,612,300 | A | 3/1997 | von Blücher et al. | 510/110 |
| 5,681,805 | A | 10/1997 | Scheuing et al. | 510/277 |
| 5,760,089 | A | 6/1998 | Cronce | 514/643 |
| 5,859,064 | A | 1/1999 | Cronce | 514/643 |

*Primary Examiner*—Steven P. Griffin
*Assistant Examiner*—Eileen E. Nave
(74) *Attorney, Agent, or Firm*—James B. Bechtel, Esq.; Wyatt B. Pratt, Esq.

(57) ABSTRACT

A method for using a chemical and biological warfare agent decontaminating solution having a peroxygen compound and bleach activator. The peroxygen compound and bleach activator are mixed in a surfactant system to generate a peroxycarboylic acid in-situ to detoxify warfare agents.

13 Claims, No Drawings

CHEMICAL AND BIOLOGICAL WARFARE DECONTAMINATING SOLUTION USING BLEACH ACTIVATORS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to a chemical warfare agent decontamination solution. More particularly, the decontamination solution includes a peroxygen component and bleach activator to generate a peroxycarboxylic acid in-situ. Most particularly, the decontaminating solution contains a microemulsion for applying a formed peroxycarboxylic acid. The decontaminating solution is useful in neutralizing chemical and biological warfare agents.

2. Brief Description of the Related Art

Methods for decontamination of chemical warfare agents, which include a variety of organophosphorus and organosulfur compounds, are known in the art. However, these known methods use compositions which have certain undesirable properties, including corrosiveness, flammability and toxicity. For example, hypochlorite formulations are very corrosive and toxic. Additionally, application of the hypochlorite decontaminant often requires substantial scrubbing for removal and destruction of the chemical warfare agent, a procedure which limits its use.

One decontaminant, Decontamination Solution 2 (DS2) used by the United States Army, is useful against a variety of chemical and biological warfare agents. DS2 contains 70% diethylenetriamine, 28% ethylene glycol monomethyl ether and 2% sodium hydroxide. However, DS2 spontaneously ignites upon contact with hypochlorites and hypochlorite-based decontaminants. Further, DS2 may cause corrosion to aluminum, cadmium, tin and zinc after prolonged contact, and softens and removes paint. Similar corrosion and human toxicity problems exist with the bleach decontamination solution (HTH) used by the United States Navy.

Strong oxidizers may be used to detoxify warfare agent, however, several problems exist with the use of the strong oxidizers. The reactivity of most strong oxidizers inhibit long shelf life of any decontaminating solution, tend to be corrosive, and are hazardous to humans and the environment. One type of strong oxidizer is the peroxycarboxylic acids or "peracids" that do not possess most of the corrosive and hazardous characteristics, however, the peracids become unstable over short time periods, such as two or three months.

Bleaching agents are known in the detergent art for decolorization of stains. Bleaching agents irreversibly oxidize and decolorize bleachable soils present on fabrics. One type of bleaching agent contains peroxygen atoms, such as sodium perborate tetrahydrate ($NaBO_4.4H_2O$) and sodium perborate monohydrate ($NaBO_4.H_2O$). The peroxygen compounds contain two linked oxygen atoms (—O—O—), that provide an active, or free, oxygen when the link is broken. Peroxygen bleaches are known as being effective for stain and soil removal from fabrics. Detergent compositions also use bleaching agents to form peroxycarboxylic acids from bleaching activators. These detergent compositions generally contain approximately 0.03% bleaching agents and bleach activator during wash.

In view of the foregoing, there is a need for an effective chemical warfare agent decontamination solution which is noncorrosive, nontoxic, nonflammable, and environmentally safe. The present invention addresses this and other needs.

SUMMARY OF THE INVENTION

The present invention includes a method for decontaminating chemical and biological warfare agents comprising the steps of mixing a peroxygen compound with a bleach activator to generate a peroxycarboxylic acid in-situ and contacting a warfare agent with the generated in-situ peroxycarboxylic acid in an amount to effectively react with the warfare agent.

The present invention also includes a chemical and biological warfare agent decontaminating solution comprising a peroxygen compound and an effective amount of bleach activator, with the peroxygen compound and bleach activator mixed in a surfactant composition prior to contacting a warfare agent.

The present invention further includes an in-situ generated peroxycarboylic acid composition for decontaminating chemical and biological warfare agents formed from the process comprising the step of mixing a peroxygen compound with a bleach activator in a surfactant composition to generate the peroxycarboxylic acid in-situ prior to contacting a warfare agent.

DETAILED DESCRIPTION OF THE PREFERRED EMBODIMENT

The present invention comprises an in-situ decontaminating solution for chemical and biological warfare applications. The decontaminating solution comprises a peroxycarboxylic acid generated from the mixing of a peroxygen compound with a bleach activator. The peroxycarboxylic acid is generated in-situ to overcome degradation of the decontaminating solution with time.

The decontaminating solution is applied onto a contaminated area or surface to neutralize or detoxify the chemical and/or biological warfare agent. Application of the decontamination solution includes placing the peroxygen compound or bleach activator in a surfactant composition, and mixing the peroxygen compound and bleach activator therein. The mixing of the peroxygen compound and bleach activator in the surfactant system generates a resultant peroxycarboxylic acid in-situ. The generated in-situ peroxycarboxylic acid is contacted with a warfare agent which reacts with the peroxycarboxylic acid and become detoxified. The solution is applied by mops, brushes, sprayers and other known solution applicators. The decontaminating solution of the present invention is noncorrosive, nontoxic, and nonflammable, and useful in rapidly neutralizing chemical and biological warfare agents, such as VX, GD and HD, and vegetative and endospore forming bacteria, fungi and virus.

Effective amounts of the peroxycarboxylic acid are determinable by those skilled in the art for specific concentrations of warfare agent, types and amounts of peroxygen and bleach activator components, contact methods, additional chemical warfare countermeasures, operational necessities, and other like factors considered for personnel ingress and egress from an exposed area. Preferably, effective detoxification includes normal human contact within a previously contaminated environment that has been treated with the decontamination solution of the present invention without any adverse health effects.

The peroxygen compound of the present invention includes any suitable peroxygen compound for reaction with a bleach activator to form an effective peroxycarboxylic acid for warfare agent neutralization. Preferred peroxygen compounds include, without limitation, percarbonates, perborates and other like compounds, with exemplary compounds including peracetate, perborate monohydrate, perborate tetrahydrate, monoperoxyphthalate, peroxymonosulfate, peroxydisulfate, percarbonate and hydrogen peroxide. Most preferably, hydrogen peroxide is used.

Hydrogen peroxide sources are well known in the art. They include the alkali metal peroxides, organic peroxide bleaching compounds such as urea peroxide, and inorganic persalt bleaching compounds, such as the alkali metal perborates, percarbonates, and perphosphates. Mixtures of two or more such peroxygen compounds also may be suitable for use within the scope of the present invention. Preferred compounds are sodium percarbonate, sodium perborate tetrahydrate and, especially, sodium perborate monohydrate. Sodium perborate monohydrate is preferred to tetrahydrate because it has excellent storage stability while also reacting quickly with bleach activators. This rapid reaction may form higher levels of percarboxylic acid which tend to enhance neutralization of warfare agents.

Typically, the molar ratio of hydrogen peroxide (or a peroxide compound generating the equivalent amount of $H_2O_2$) to bleach activator ranges from about 1.5:1 to about 4:1, preferably about 2:1 to about 4:1, most preferably from about 2.5:1 to about 3.5:1, such as 3:1. In such formulations the total amount of peroxygen compound, e.g., sodium perborate mono- or tetra-hydrate, may be present at a level within the range of from about 5% to about 50%, preferably from about 10% to about 25%, particularly from about 15% to about 20% by weight, such as about 18% by weight; and the bleach activator may range from about 2% to about 20% by weight, preferably from about 5% to about 15% by weight, particularly from about 5% to about 8% by weight, such as about 7% by weight.

The bleach activator of the present invention includes suitable organic compounds for forming an effective peroxycarboxylic acid with the peroxygen compound present, and provide surface active molecules which aid in dissolving the warfare agents. The term "bleach activator" refers to a compound which reacts with hydrogen peroxide or its anion to form a more effective oxidant. By bleach activator, it is meant herein any compound, or mixtures of compounds, that reacts with a peroxygen, i.e., a hydrogen peroxide, to form a peracid. Without intending to be limited by theory, it is believed that bleach activators undergo a perhydrolysis reaction with the peroxygen bleach to yield a peroxycarboxylic acid. Bleach activators may belong to any of several classes of chemical compounds, such as esters, amides, imides, or anhydrides, and include such compounds as perhydrolyzable acyls having a leaving group such as oxybenzenesulfonate. The appropriate bleach activator of the present invention may be determinable by those skilled in the art for a given use and peroxygen reacting compound. Selection may vary with the advantages or deficiencies of particular bleach activators, such as low compatibility with additional components, limited storage stability, low mass efficiency, surfactant incompatibility, tendencies to produce malodorous peracids, synthesis difficulty, lack of biodegradability, and high cost. Exemplary bleach activators of the present invention include, without limitation, nonanoyloxybenzene sulfonate (NOBS), sodium nonanoyloxybenzene sulfonate (SNOBS), tetraacetylethylenediamine (TAED), tetraacetyl glycoluril (TAGU), pentaacetyl glucose (GAG), lauroyloxybenzene sulfonate (LOBS) and decanoyloxybenzenecarboxylic acid (DOBA). The bleach activators of nonanoyloxybenzene sulfonate (NOBS) or tetraacetylethylenediamine (TAED) are most preferred.

The term "perhydrolysis" is well known and relates to the reaction of a bleach activator with a peroxygen to form the peracid. For example, a bleach activator structure having the form RC(O)L, wherein RC(O) is an acyl moiety and L is a leaving-group is shown in formula (I), below:

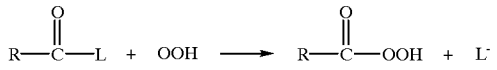

The activator reacts with hydrogen peroxide or a hydrogen peroxide source such as sodium percarbonate or perborate, typically in alkaline aqueous solution, to form a peracid, typically a percarboxylic acid RC(O)OOH or its anion, with loss of a leaving-group, L, or its conjugate acid LH. The terms "peracid" and "peroxyacid" may be used interchangeably as equivalent terms herein. The selected bleach activators herein may in one mode be conveniently described by reference to the peracids they form when perhydrolyzed. It is convenient to do this, inter-alia because it permits unambigous identification of the location of particular hydrophilic substituents. In general, the leaving groups of the selected bleach activators herein may vary widely. The term "leaving group" is well defined in standard texts. The acidic —OOH moieties of the peroxygen compound or peracid encompass both the protonated and deprotonated, i.e., peroxyanion —OO—forms, with these forms interconvertible depending on their $pK_a$ and the conditions of pH and concentration.

The hydrogen peroxide source (peroxygen), such as sodium perborate, and bleach activator of the present invention are reacted to create the peroxycarboxylic acid. As previously stated, either the peroxygen compound or bleach activator is placed and stored in the emulsion and the non-present component is added prior to use. For example, TAED is added to an emulsion containing sodium perborate, and mixed, to form the peroxycarboxylic acid. Alternatively, sodium perborate is added to an emulsion containing TAED, and mixed, to form the peroxycarboxylic acid. In either process, the peroxycarboxylic acid of diperoxydodecanedioic acid (DPDDA) is formed within the emulsion prior to use.

The emulsion of the present invention preferably includes a microemulsion comprising surfactant compositions or systems having one or more surfactants, water and hydrocarbon compound. Low interfacial tension of the surface active compounds found within the emulsion helps dissolve the warfare agents, aiding detoxification from increased intimate contact between the oxidizer and warfare agent. The microemulsion comprises the combined surfactant component in an amount of from about 5 wt % to about 60 wt %, water in an amount of from about 5 wt % to about 60 wt %, and hydrocarbon compound in an amount of from about 5 wt % to about 60 wt %. An exemplary microemulsion composition includes approximately 42.4 wt % water, 17.2 wt % decane and 24.6 wt % surfactants (neat). Buffers, and other known microemulsion additives may be added, as desired. Microemulsions have been disclosed to extract warfare agents which are then washed off, as detailed in U. S. Pat. No. 5,612,300 to von Blucher et al., the disclosure of which is herein incorporated by reference.

Surfactants used within the microemulsion preferably include two amine oxide surfactants. The amine oxide surfactants may include, for example, any N-alkyldimethylamine or N-dialkylmethylamine oxide, having $C_{10}$, $C_{12}$, $C_{14}$, $C_{16}$ alkyls or mixtures of these. Exemplary surfactants include didecyl methylamine oxide manufactured by Albemarle Chemical of Baton Rouge, La. and sold under the tradename "Damox 1010" (76%), and decyl dimethylamine oxide manufactured by Lonza Chemical of Fair Lawn, N.J., and sold under the tradename "Barlox 10S" (30%). Preferred surfactant systems include amine oxides.

Microemulsions of the present invention comprises a water content of from about 5% to about 60% by weight with a hydrocarbon component dispersed therein. The hydrocarbon or oil component of the microemulsion may non-exclusively include alkane compounds with from about $C_5$ or higher, such as decane ($C_{10}$), dodecane ($C_{12}$), tetradecane ($C_{14}$), and hexadecane ($C_{16}$). The alkane should be nontoxic, nonflammable and resistant to oxidation. The hydrocarbon component is preferably present in amounts of from about 5% to about 60% by weight.

With the component parts of the decontaminating solution mixed, the peroxycarboxylic acid is then generated. The peroxycarboxylic acid is the oxidizing agent which attacks the chemical and biological warfare agents. As the peroxycarboxylic acid attacks the warfare agent, the microemulsion provides a medium to enhance contact of the peroxycarboxylic acid with the chemical warfare agents. Once the warfare agent has been detoxified, the residual components of the decontaminating solution and warfare agent may be removed by any known method, such as a water rinse, or soap and water. Any known method of rinsing may be used, such as application of the water by hose, mop, scrubbers and the like.

The perhydrolysis product of the peroxygen compound and bleach activator in the microemulsion preferably comprises an effective amount or detoxifying amount of formed peroxycarboxylic acid. An "effective amount" is any amount capable of measurably improving environmental conditions. Preferably, the microemulsions comprise from about 5% to about 30% by weight of peroxycarboxylic acid, preferably from about 5% to about 20%, most preferably from about 5% to about 10% by weight, such as 8.7% by weight. The generated peroxycarboxylic acid degrades with time, and is used promptly, preferably immediately after mixing of the peroxygen compound and bleach activator.

With the peroxycarboxylic acid generated in-situ, normal storage of the decontaminating solution of the present invention includes kits or other similar applicators that maintain the peroxygen compound separate from the bleach activator. As such, shelf life of the decontaminating solution is greatly extended. Either component, peroxygen compound or bleach activator, may be stored in a mixed state with the microemulsion, with the preparation of the decontaminating solution, i.e., mixing the peroxygen compound with the bleach activator to form the peroxycarboylic acid, prior to the application of the decontaminating solution on the warfare agent. Preferably, the mixing of the peroxygen compound with the bleach activator to form the peroxycarboylic acid occurs immediately prior to the application of the peroxycarboxylic acid on a surface contaminated with a warfare agent.

The decontaminating agent compositions of the present invention are nontoxic and useful in detoxifying/neutralizing a variety of chemical warfare agents, including organosulfur agents such as mustard gas (HD), and organophosphorus agents such as the nerve agents termed VX and GD. The decontaminating agents of the present invention may also be used to neutralize selected organophosphorus agricultural chemicals. Decontamination is effected by applying a decontaminating agent of the present invention to the contaminated material, equipment, personnel, or the like. Such application includes any suitable means for applying a solution onto a contaminated surface, with the type and manner of application determinable by those skilled in the art, such as spraying, showering, washing or other suitable means. Generally, such application is guided by decreasing the exposure, initial or continuous, of the contaminating warfare agent to personnel.

The amount of decontaminating solution required under military operational conditions can be readily determined by those skilled in the art.

EXAMPLE 1

A microemulsion of a two component surfactant, decane and water is used to produce a single phase system. The bleach activator (a powder) was dissolved in the microemulsion after which the peroxygen compound (hydrogen peroxide) was added.

A microemulsion decontaminating solution was formulated of 296-mg of 76% didecyl methylamine oxide, 499-mg of 30% decyldimethylamine oxide, 394-mg decane, 224-mg of water, 110-mg of a bleach activator (nonanoyloxybenzene sulfonate (NOBS) manufactured by The Procter & Gamble Company of Cincinnati, Ohio), and 37-mg of sodium carbonate (buffer). 96-mg of 30% hydrogen peroxide was then added and a peroxycarboxylic acid of pernonanoic acid was generated in-situ.

The pernonanoic acid was tested for neutralization of chemical warfare agents, as shown in Table 1, below:

TABLE 1

| | % Neutralization Over Time | | | |
|---|---|---|---|---|
| Warfare Agent | 1 minute | 10 minutes | 20 minutes | 60 minutes |
| HD | 98.4 | 99.9 | 99.9 | 99.9 |
| GD | 96.9 | 99.9 | 99.9 | 99.9 |
| VX | 85.6 | 89.1 | 91.3 | 93.4 |

The decontamination solution of the present invention reduces or neutralizes the effects of chemical or biological warfare agents within a reasonable time. The decontamination solution presents a compatible "wash" for military systems, showing minimal adverse affects on the operation and function of the systems, while presenting minimal health hazards to personnel.

The foregoing summary, description, and example of the present invention are not intended to be limiting, but are only exemplary of the inventive features which are defined in the claims.

What is claimed is:

1. A method for decontaminating chemical and biological warfare agents, comprising the steps of:

mixing a peroxygen compound with a bleach activator, wherein a peroxycarboxylic acid is generated in-situ; and, contacting a warfare agent with the generated in-situ peroxycarboxylic acid, effective to react with and neutralize the warfare agent.

2. The method of claim 1, wherein the step of contacting the warfare agent effectively detoxifies the warfare agent.

3. The method of claim 1, wherein the peroxygen compound comprises a compound selected from the group consisting of percarbonate, perborate and hydrogen peroxide.

4. The method of claim 1, wherein the peroxygen compound comprises a compound selected from the group consisting of peracetate, perborate monohydrate, perborate tetrahydrate, monoperoxyphthalate, peroxymonosulfate, peroxydisulfate, percarbonate and hydrogen peroxide.

5. The method of claim 1, wherein the bleach activator comprises a compound selected from the group consisting of nonanoyloxybenzene sulfonate (NOBS), tetraacetylethylenediamine (TAED), lauroyloxybenzene sulfonate (LOBS) and decanoyloxybenzenecarboxylic acid (DOBA).

6. The method of claim 1, wherein the step of mixing further comprises a surfactant composition.

7. The method of claim 6, wherein the surfactant composition comprises an amine oxide.

8. The method of claim 6, wherein the surfactant composition comprises a microemulsion.

9. The method of claim 8, wherein the mixture of peroxygen compound, bleach activator and microemulsion comprises a reacted compound formed from about 20 wt % to about 50 wt % peroxygen compound, from about 2 wt % to about 20 wt % bleach activator and from about 50 wt % to about 95 wt % microemulsion.

10. The method of claim 8, wherein the microemulsion comprises a surfactant component having at least two surfactants, water and a hydrocarbon compound.

11. The method of claim 9, wherein the microemulsion comprises the surfactant component in an amount of from about 20 wt % to about 90 wt %, water in an amount of from about 5 wt % to about 40 wt %, and a hydrocarbon compound in an amount of from about 5 wt % to about 40 wt %.

12. The method of claim 1, further comprising the step of removing the reacted warfare agent and peroxycarboxylic acid.

13. The method of claim 12, wherein the step of removing the reacted warfare agent and peroxycarboxylic acid comprises rinsing.

* * * * *